US006534237B1

(12) United States Patent
Kawamura et al.

(10) Patent No.: US 6,534,237 B1
(45) **Date of Patent: *Mar. 18, 2003**

(54) HEAT-SENSITIVE LITHOGRAPHIC PRINTING PLATE

(75) Inventors: Koichi Kawamura, Shizuoka (JP); Hiroshi Tashiro, Shizuoka (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/563,349

(22) Filed: May 3, 2000

(30) Foreign Application Priority Data

May 13, 1999 (JP) ..... 11-132855

(51) Int. Cl.[7] ..... G03F 7/09

(52) U.S. Cl. ..... 430/270.1; 430/271.1; 430/944; 430/945

(58) Field of Search ..... 430/270.1, 271.1, 430/302, 303, 944, 945

(56) References Cited

U.S. PATENT DOCUMENTS

| | | | | | |
|---|---|---|---|---|---|
| 5,731,123 | A | * | 3/1998 | Kawamura et al. | 430/176 |
| 6,017,677 | A | * | 1/2000 | Maemoto et al. | 430/270.1 |
| 6,096,471 | A | * | 8/2000 | Van Damme et al. | 430/188 |
| 6,096,479 | A | * | 8/2000 | Kawamura et al. | 430/270.1 |
| 6,114,083 | A | * | 9/2000 | Kawamura et al. | 430/270.1 |
| 6,132,934 | A | * | 10/2000 | Vermeersch et al. | 430/273.1 |
| 6,136,503 | A | * | 10/2000 | Zheng et al. | 430/270.1 |
| 6,146,812 | A | * | 11/2000 | Leon et al. | 430/270.1 |
| 6,153,352 | A | * | 11/2000 | Oohashi et al. | 430/270.1 |
| 6,159,657 | A | * | 12/2000 | Fleming et al. | 430/270.1 |
| 6,162,578 | A | * | 12/2000 | Zheng et al. | 430/270.1 |
| 6,165,679 | A | * | 12/2000 | Van Damme et al. | 430/270.1 |
| 6,165,691 | A | * | 12/2000 | Damme et al. | 430/303 |
| 6,177,230 | B1 | * | 1/2001 | Kawamura | 430/270.1 |
| 6,214,515 | B1 | * | 4/2001 | Van Damme et al. | 430/188 |
| 6,242,155 | B1 | * | 6/2001 | Yamasaki et al. | 430/270.1 |
| 2001/0009129 | A1 | * | 7/2001 | Kunita et al. | 101/453 |
| 2002/0023565 | A1 | * | 2/2002 | Kawamura et al. | 101/453 |

FOREIGN PATENT DOCUMENTS

| | | | |
|---|---|---|---|
| EP | 0 652 483 | A1 * | 5/1995 |
| EP | 0 819 986 | A | 1/1998 |
| GB | 1 245 924 | A | 9/1971 |
| JP | 10 006468 | A | 1/1998 |
| JP | 10 282672 | A | 10/1998 |

* cited by examiner

*Primary Examiner*—Janet Baxter
*Assistant Examiner*—Barbara Gilliam
(74) *Attorney, Agent, or Firm*—Burns, Doane, Swecker & Mathis, LLP

(57) ABSTRACT

A heat-sensitive lithographic printing plate in which the occurrence of stains in printing can be prevented without increasing the exposure of a laser, comprising a support having provided thereon a hydrophilic layer having a crosslinked structure, and a layer containing a polymer having on a side chain a group in which the solubility in water can be changed by heat, the layer being provided on the hydrophilic layer.

2 Claims, No Drawings

HEAT-SENSITIVE LITHOGRAPHIC PRINTING PLATE

FIELD OF THE INVENTION

The present invention relates to a heat-sensitive lithographic printing plate, and particularly to a heat-sensitive lithographic printing plate requiring no development processing after image recording and good in resistance to staining.

BACKGROUND OF THE INVENTION

Conventional methods for directly plate-making printing plates from digitized image data without using lithographic films include (1) electrophotographic methods, (2) methods using high-sensitive photopolymers writable with relatively low-output lasers emitting-blue or green light, (3) methods using silver salts, or composite systems of silver salts and other systems and (4) methods of generating acids by heat mode laser exposure, and conducting after-heating using the acids as catalysts, thereby obtaining thermoset images.

These methods are very useful in respect to rationalization of the printing processes, but they are not necessarily satisfactory in the present circumstances. For example, in the electrophotographic methods of (1), processes of image formation such as electrification, exposure and development are complicated to cause complicated and large-scale apparatus. In the methods using photopolymers of (2), high-sensitive printing plates are used, so that illuminated room processing becomes difficult. The methods using silver salts of (3) have the disadvantages that processing becomes complicated, and that silver is contained in waste liquid. The methods of (4) also necessitate after heating and subsequent development processing, resulting in complicated processing.

Further, the production of these printing plates contains the wet development stage for imagewise removing recording layers provided on surfaces of supports, and the after processing stage that developed printing plates are washed with water or processed with rinsing solutions containing surfactants and desensitizing solutions containing gum arabic and starch derivatives, after the exposure stage.

On the other hand, in the fields of platemaking and printing, plate-making operations have recently been rationalized, and printing plate precursors which necessitate no complicated wet development processing as described above and can be used for printing as such after exposure have been desired.

For example, JP-A-10-282672 (the term "JP-A" as used herein means an "unexamined published Japanese patent application") discloses heat-sensitive lithographic printing plate precursor having layers containing hydrophobic polymers which necessitate no processing and in which side chains are turned hydrophilic by heat. The printing plate precursor is characterized by that the polymer turned hydrophilic by exposure is developed with a fountain solution on a printing machine, which causes no particular need to conduct development processing. However, high heat-conductive aluminum is used as a substrate, so that heat generated by exposure and the action of a light-heat converting agent is diffused in the aluminum substrate. The printing plate precursor therefore has the characteristic that the temperature in the vicinity of a surface of the substrate is hard to increase. Accordingly, the heat reaction of the polymer does not sufficiently proceed in the vicinity of the substrate, and the polymer is not turned hydrophilic.

Therefore, the polymer is not completely removed in the on-press development and remains as a residual film, which sometimes causes stains in printing. For completely removing the polymer, therefore, it is necessary to increase the exposure of a laser.

SUMMARY OF THE INVENTION

It is therefore an object of the invention to overcome the above-mentioned disadvantages of the prior art and to provide a heat-sensitive lithographic printing plate in which the occurrence of stains in printing can be prevented without increasing the exposure amount of a laser.

The present inventors have made various studies for improving the resistance to staining of the printing plates. As a result, the inventors have discovered that the temperature of recording layers is prevented from being lowered and the solubility of polymers contained in the recording layers in water can be completely converted by providing materials lower in heat sensitivity than aluminum as crosslinked hydrophilic layers on supports, thus completing the invention.

That is, the embodiments and preferred embodiments are. shown below.

(1) A heat-sensitive lithographic printing plate comprising a support having provided thereon a hydrophilic layer having a crosslinked structure, and a layer containing a polymer having on a side chain a group in which the solubility in water of the polymer can be changed by heat (hereinafter sometimes referred to as simply "a recording layer"), said layer being provided on the hydrophilic layer.

(2) The heat-sensitive lithographic printing plate as described in the above item (1), which comprises a support having provided thereon a hydrophilic layer having a crosslinked structure, and a layer containing a polymer having on a side chain a group in which the solubility in water of the polymer can be increased by heat, said layer being provided on the hydrophilic layer.

(3) A lithographic printing plate precursor comprising a support having provided thereon in order of a hydrophilic insulating layer and a layer containing a hydrophilic polymer in which a side chain changes to hydrophobic by heat.

(4) The lithographic printing plate precursor as described in the above item (3), wherein said hydrophilic insulating layer contains a hydrophilic polymer having a crosslinked structure.

(5) The heat-sensitive lithographic printing plate as described in the above item (1), wherein said hydrophilic layer is bonded to the support via a chemical bond by light.

(6) The lithographic printing plate precursor as described in the above item (3), wherein said hydrophilic insulating layer is bonded to the support via a chemical bond by light.

In the heat-sensitive lithographic printing plate of the invention, the crosslinked hydrophilic layer formed of the material lower in heat sensitivity than aluminum is provided between the support and the recording layer, thereby preventing the temperature of the recording layer from being lowered, and making it possible to completely convert the solubility of the polymer contained in the recording layer in water. Further, the combination of the polymer having on a side chain the group in which the solubility in water of the polymer can be increased by heat and a light-heat converting agent prevents a stain due to a residual film even by low-energy IR laser beam irradiation, that is to say, it provides the effect of increasing sensitivity.

DETAILED DESCRIPTION OF THE INVENTION

The heat-sensitive lithographic printing plates of the invention will be illustrated in detail below.

There is no particular limitation on the hydrophilic layer having the crosslinked structure (hereinafter also briefly referred to as the crosslinked hydrophilic layer) contained in the heat-sensitive lithographic printing plate of the invention, as long as it is extremely lower in heat conductivity than aluminum, and one mainly composed of silica or an organic polymer is preferably used. Silica and the organic polymer used in the crosslinked hydrophilic layer of the heat-sensitive lithographic printing plate of the present invention are each about 180 times lower and 1100 to 1600 times lower, respectively, in heat conductivity than aluminum.

As the crosslinked hydrophilic layer of the heat-sensitive lithographic printing plate of the invention, any of the known crosslinked hydrophilic layers can be used. For example, (1) hydrophilic layers comprising metal colloid-containing crosslinked polymers described in PCT International Publication No. WO98/40212, (2) hydrophilic layers comprising condensates of organic hydrophilic polymers and silane coupling agents described in Japanese Patent No. 2,592,225, and (3) hydrophilic layers comprising crosslinked organic polymers described in JP-A-10-6468 and JP-A-10-58636 can be used.

The respective crosslinked hydrophilic layers are described below.

First, (1) the hydrophilic layers comprising metal colloid-containing crosslinked polymers are described.

Examples of the metal colloids include colloids of hydroxysilane, hydroxyaluminum, hydroxytitanium and hydroxyzirconium. These metal colloids can be crosslinked with crosslinking agents, for example, tri or tetraalkoxysilane, titanates or aluminates. The metal colloids can be produced according to methods described in U. S. Pat. Nos. 2,244,325 and 2,574,902. Of these, the particularly useful metal colloid is colloidal silica, and the crosslinking agent is aminopropylethoxy-silane. The amount of the metal colloid used ranges from 100% to 5000%, particularly preferably from 500% to 1500%, based on the amount of the crosslinking agent.

Next, (2) the hydrophilic layers comprising the condensates of the organic hydrophilic polymers and the silane coupling agents are described.

The hydrophilic layers are preferably cast from aqueous compositions containing, for example, hydrophilic polymers having free, reactive groups such as hydroxyl, carboxyl, hydroxyethyl, hydroxypropyl, amino, aminoethyl, aminopropyl and carboxymethyl, together with suitable crosslinking agents or modifiers including, for example, hydrophilic organic titanium reagents, aluminoformyl acetate, dimethylolurea, melamine, aldehydes and hydrolyzed tetraalkyl orthosilicates.

The polymers suitable for the hydrophilic layers can be selected from the group consisting of gum arabic, casein, gelatin, starch derivatives, carboxymethyl cellulose and the sodium salt thereof, cellulose acetate, sodium alginate, vinyl acetate-maleic acid copolymers, styrene-maleic acid copolymers, polyacrylic acids and salts thereof, polymethacrylic acids and salts thereof, hydroxyethylene polymers, polyethylene glycol derivatives, hydroxypropylene polymers, polyvinyl alcohols and hydrolyzed polyvinyl acetate having a degree of hydrolysis of at least 60% by weight, preferably at least 80% by weight.

For example, a hydrophilic layer containing polyvinyl alcohol as described in U.S. Pat. No. 3,476,937 or polyvinyl acetate hydrolyzed to a degree of at least about 60% by weight and hardened with a tetraalkyl orthosilicate such as tetraethyl orthosilicate or tetramethyl orthosilicate is particularly preferred, because the use of the hydrophilic layer in the heat-sensitive lithographic printing plate of the invention gives excellent lithographic printability.

Another suitable hardened hydrophilic surface layer is disclosed in EP-A-91201227.5. The hydrophilic layer disclosed in the EP application contains a hardened reaction product of a copolymer containing an amine or amido functional group having at least one free hydrogen atom (for example, amino-modified dextran) and an aldehyde.

According to the heat-sensitive lithographic printing plates of the invention, the hardened hydrophilic surface layers can contain additional materials such as plasticizers, pigments and dyes. The hardened hydrophilic surface layers can also contain granular materials such as $TiO_2$ and colloidal silica for increasing the strength and/or hydrophilicity of the hydrophilic layers.

Then, (3) the hydrophilic layers formed of crosslinked organic polymers are described.

The crosslinked organic polymers as used in the invention are network polymers each having one or more kinds and a plurality of hydrophilic functional groups such as carboxyl, amino, phosphoric acid, sulfonic acid or salts of them, hydroxyl, amicto and polyoxyethylene groups as side chains on polymers composed of carbon-carbon bonds, or network polymers each having one or more kinds and a plurality of hydrophilic functional groups such as carboxyl, amino, phosphoric acid, sulfonic acid or salts of them, hydroxyl, amido and polyoxyethylene groups on polymers formed by the connection of heteroatoms comprising at least one kind of atom selected from oxygen, nitrogen, sulfur and phosphorus atoms, or on side chains thereof. Specific examples thereof include poly(meth)acrylate, polyoxyalkylenes, polyurethanes, epoxy ring-opening addition polymers, poly (meth)acrylic acids, poly(meth)acrylamides, polyesters, polyamides, polyamines, polyvinyl compounds, polysaccharides and composite polymers thereof.

In particular, the polymers repeatedly having any of hydroxyl groups, carboxyl groups or alkali metal salts thereof, amino groups or hydrogen halide salts thereof, sulfonic acid groups or amines, alkali metal salts or alkaline earth metal salts thereof, amido groups and combinations thereof on side chains of segments, or the polymers further having polyoxyethylene groups, as well as these hydrophilic functional groups, on parts of main segments are preferred because of their high hydrophilicity. In addition to these, hydrophilic binder polymers having urethane bonds or urea bonds in main chains or side chains thereof are more preferred, because not only the hydrophilicity, but also the printing durability of non-image areas is improved.

The binder polymers may contain other various components described later, as needed. Specific examples of the three-dimensionally crosslinked hydrophilic binder polymers include hydrophilic homopolymers and copolymers synthesized using at least one kind of monomer selected from hydrophilic monomers having hydrophilic groups such as hydroxyl groups, carboxyl groups or salts thereof, sulfonic acid groups or salts thereof, phosphoric acid groups or salts thereof, amido groups, amino groups and ether groups, such as (meth)acrylic acid or alkali salts and amine salts thereof, itaconic acid or alkali salts and amine salts thereof, 2-hydroxyethyl (meth)acrylate, (meth)acrylamide, N-monomethylol(meth)acrylamide, N-dimethylol(meth) acrylamide, 3-vinylpropionic acid or alkali salts and amine salts thereof, vinylsulfonic acid or alkali salts and amine salts thereof, 2-sulfoethyl (meth)acrylate, polyoxyethylene glycol (meth)acrylate, 2-acrylamide-2-methylpropanesulfonic acid, acid phosphoxypolyoxyethylene glycol mono((meth)acrylate, and allylamine or mineral acid salts thereof.

Addition polymerizable double bonds such as vinyl, allyl and (meth)acrylic groups or ring forming groups such as cinnamoyl, cinnamylidene, cyanocinnamylidene and p-phenylene diacrylate groups are introduced into the hydrophilic binder polymers having functional groups such as hydroxyl groups, carboxyl groups, amino groups or salts thereof and epoxy groups to obtain unsaturated group-containing polymers, utilizing these functional groups. Monofunctional or multifunctional monomers copolymerizable with the unsaturated groups, polymerization initiators described later and other components described later are added thereto as needed, and dissolved in appropriate solvents to prepare dopes. The dopes are applied onto supports, and three-dimensionally crosslinked after drying or together with drying.

The hydrophilic binder polymers having active hydrogen-containing groups such as hydrosxyl, amino and carboxyl groups are added to organic solvents containing no active hydrogen, together with isocyanate compounds or block polyisocyanate compounds and other components described later, to prepare dopes. The dopes are applied onto supports, and three-dimensionally crosslinked after drying or together with drying. As copolymerization components of the hydrophilic binder polymers, monomers having glycidyl groups such as glycidyl (meth)acrylate or monomers having carboxyl groups such as (meth)acrylic acid can be used in combination. The hydrophilic binder polymers having glycidyl groups can be thee-dimensionally crosslinked, using α,ω-alkane or alkenedicarboxylic acids such as 1,2-ethanedicarboxylic acid and adipic acid, polycarboxylic acids such as 1,2,3-propanetricarboxyxlic acid and trimellitic acid, polyamines such as 1,2-ethanediamine, diethylenediamine, diethylene-triamine and α,ω-bis(3-aminopropyl) polyethylene glycol ether, oligoalkylenes or polyalkylene glycols such as ethylene glycol, propylene glycol, diethylene glycol and tetraethylene glycol, and polyhydroxy compounds such as trimethyloipropane, glycerol, pentaerythritol and sorbitol as crossl inking agents, and utilizing the ring opening reaction with them.

The hydrophilic binder polymers having carboxyl groups or amino groups can be thee-dimensionally crosslinked, utilizing the epoxy ring opening reaction using polyepoxy compounds such as ethylene or propylene glycol diglycidyl ether, polyethylene or polypropylene glycol diglycidyl ether, neopentyl glycol diglycidyl ether, 1,6-hexanediol diglycidyl ether and trimethylolpropane triglycidyl ether as crosslinking agents.

When the hydrophilic binder polymers are polysaccharides such as cellulose derivatives, polyvinyl alcohol or partially saponified products thereof, glycidyl homopolymer or copolymers, or hydrophilic binder polymers based on them, the above-mentioned crosslinkable functional groups are introduced into the hydrophilic binder polymers, utilizing hydroxyl groups contained therein, to be able to provide the three-dimensional crosslinked structure by the above-mentioned method.

Of the above, the hydrophilic homopolymers and copolymers synthesized using at least one kind of monomer selected from the hydrophilic monomers having hydrophilic groups such as carboxyl groups, sulfonic acid groups, phosphoric acid groups, amino groups, salts of them, hydroxyl groups, amido groups and ether groups, such as (meth) acrylic acid or alkali salts and amine salts thereof, itaconic acid or alkali salts and amine salts thereof, 2-hydroxyethyl (meth)acrylate, (meth)acrylamide, N-monomethylol(meth)-acrylamide, N-dimethylol(meth)acrylamicie, allylamine or halide acid salts thereof, 3-vinylpropionic acid or alkali salts and amine salts thereof, vinylsulfonic acid or alkali salts andamine salts thereof, 2-sulfoethylene (meth)acrylate, polyoxyethylene glycol (meth)acrylate, 2-acrylamide-2-methylpropanesulfonic acid and acid phosphoxypolyoxyethylene glycol mono((meth)acrylate, or the hydrophilic binder polymers composed of polyoxymethylene glycol or polyoxyethylene glycol are preferably three-dimensionally crosslinked by the above-mentioned method.

The film thickness of the crosslinked hydrophilic layers of the heat-sensitive lithographic printing plates of the invention is preferably from 0.05 μm to 50 μm, and more preferably from 0.1 μm to 10 μm. Less than 0.05 μm does not give the heat insulation effect of the hydrophilic layers, whereas exceeding 50 μm results in brittle films to cause deterioration of the printing durability (i.e., press life).

The crosslinked hydrophilic layer is preferably bonded to the support by covalent bonding.

Specifically, it is preferred that the unsaturated group on the support should be bonded to the unsaturated group contained in the crosslinked hydrophilic layer by light.

In the heat-sensitive lithographic printing plates of the invention, the recording layers provided on the crosslinked hydrophilic layers and containing the polymers having on their side chains groups increasing solubility in water by heat are described below.

There is no particular limitation of the polymer contained in the recording layer of the heat-sensitive lithographic printing plate of the invention and changeable in solubility in water by heat (hereinafter also briefly referred to as a polarity converting polymer). Examples of the polymers include polymers having on their side chains at least one of functional groups represented by the following formulas (1) to (5):

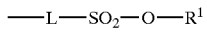

(1)

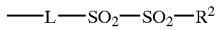

(2)

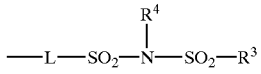

(3)

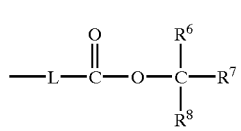

(4)

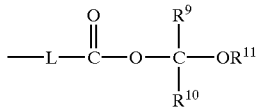

(5)

wherein L represents an organic group comprising a multivalent nonmetallic atom connected to a main chain of a polymer; $R^1$ represents an aryl group, an alkyl group or a cyclic imido group; $R^2$ and $R^3$ each represents an aryl group or an alkyl group; $R^4$ represents an aryl group, an alkyl group or —SO—$R^5$; $R^5$ represents an aryl group or an alkyl group; $R^6$, $R^7$ and $R^8$ each independently represents an aryl group or an alkyl group; any two or three of $R^6$, $R^7$ and $R^8$ may form a ring; one of $R^9$ and $R^{10}$ represents a hydrogen atom, and the other represents a hydrogen atom, an aryl group or an alkyl group; $R^{11}$ represents an alkyl group; and $R^9$ and $R^{11}$ or $R^{10}$ and $R^{11}$ may form a ring.

L is a multivalent connecting group comprising a non-metallic atom, and composed of 1 to 60 carbon atoms, 0 to 10 nitrogen atoms, 0 to 50 oxygen atoms, 1 to 100 hydrogen atoms and 0 to 20 sulfur atoms. More specifically, L is constituted by a combination of the following structure units:

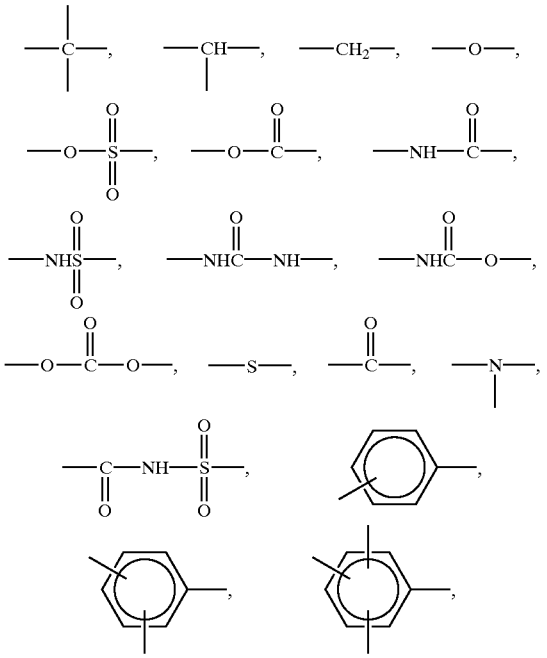

Multivalent naphthalene, Multivalent anthracene.

When the multivalent connecting groups have substituents, the substituents which can be used include alkyl groups each having 1 to 20 carbon atoms such as methyl and ethyl, aryl groups each having 6 to 16 carbon atoms such as phenyl and naphthyl, hydroxyl, carboxyl, sulfonamido, N-sulfonylamido, acyloxy groups each having 1 to 6 carbon atoms such as acetoxy, alkoxyl groups each having 1 to 6 carbon atoms such as methoxy and ethoxy, halogen atoms such as chlorine and bromine, alkoxycarbonyl groups each having 2 to 7 carbon atoms such as methoxycarbonyl, ethoxycarbonyl and cyclohexylcarbonyl, cyano, and carbonate groups such as t-butyl carbonate.

When $R^1$ to $R^5$ represent aryl groups or substituted aryl groups, the aryl groups include carbocyclic aryl groups and heterocyclic aryl groups. As the carbocyclic aryl groups, ones each having 6 to 19 carbon atoms, such as phenyl, naphthyl, anthracenyl and pyrenyl, are used. As the heterocyclic aryl groups, ones each having 3 to 20 carbon atoms and 1 to 5 heteroatoms, such as pyridyl, furyl, quinolyl obtained by cyclocondensation of a benzene ring, benzofuryl, thioxanthone and carbazole, are used. When $R^1$ to $R^5$ represent alkyl groups or substituted alkyl groups, the alkyl groups which are used include straight-chain, branched or cyclic ones each having 1 to 25 carbon atoms, such as methyl, ethyl, isopropyl, t-butyl and cyclohexyl.

When $R^1$ to $R^5$ are substituted aryl groups, substituted heteroaryl groups or substituted alkyl groups, the substituents include alkoxyl groups each having 1 to 10 carbon atoms such as methoxy and ethoxy; halogen atoms such as fluorine, chlorine and bromine; halogen-substituted alkyl groups such as trifluoromethyl and trichloromethyl; alkoxycarbonyl or aryloxycarbonyl groups each having 2 to 15 carbon atoms such as methoxycarbonyl, ethoxycarbonyl, t-butyloxycarbonyl and p-chlorophenyloxycarbonyl; hydroxyl; acyloxy groups such as acetyloxy, benzoyloxy and p-diphenylaminobenzoyloxy; carbonate groups such as t-butyloxycarbonyloxy; ether groups such as t-butyloxycarbonylmethyloxy and 2-pyranyloxy; substituted or unsubstituted amino groups such as amino, dimethylamino, diphenylamino, morpholino and acetylamino; thioether groups such as methylthio and phenylthio; alkenyl groups such as vinyl and styryl; nitro; cyano; acyl groups such as formyl, acetyl and benzoyl; aryl groups such as phenyl and naphthyl; and heteroaryl such as pyridyl. Further, when $R^1$ to $R^5$are substituted aryl or substituted heteroaryl groups, alkyl groups such as methyl and ethyl can be used as the substituents, in addition to the above-mentioned substituents.

When $R^1$ represents a cyclic imido group, the cyclic imido groups which can be used include ones each having 4 to 20 carbon atoms such as succinimido, phthalimido, cyclohexanedicarboximido and norbornendicarboximido.

Of the above, particularly preferred as $R^1$ are the aryl groups substituted by electron attractive groups such as halogen, cyano and nitro, the alkyl groups substituted by electron attractive groups such as halogen, cyano and nitro, the secondary or tertiary branched alkyl groups, the cyclic alkyl groups and the cyclic imido groups.

Further, of the above, particularly preferred as $R^1$ to $R^5$are the aryl groups substituted by electron attractive groups such as halogen, cyano and nitro, the alkyl groups substituted by electron attractive groups such as halogen, cyano and nitro, and the secondary or tertiary branched alkyl groups.

Of the above, $R^6$ to $R^{11}$ are preferably the alkyl groups or the aryl groups, and it is preferred that any two or three of $R^6$, $R^7$ and $R^8$ form a ring, and that $R^9$ and $R^{11}$ or $R^{10}$ and $R^{11}$ form a ring. In this case, the alkyl group and the aryl groups may have substituents. Preferred examples of the substituents include methyl, methoxy and halogen atoms.

Of the polarity converting polymers having the functional groups represented by general formulas (1) to (5), the polymers having the functional groups represented by formulas (1), (4) and (5) are preferred- Of the polymers having the functional groups represented by general formula (1), polymers having secondary alkyl groups represented by the following general formula (6) are particularly preferred.

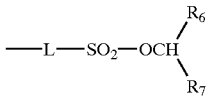

(6)

wherein $R_6$ and $R_7$ each represents a substituted or unsubstituted alkyl group or a substituted or unsubstituted aryl group, and $R_6$ and $R_7$ may form a ring together with a secondary carbon atom (CH) with which they are combined.

When $R_6$ and $R_7$ represent substituted or unsubstituted alkyl groups, the alkyl groups include straight-chain, branched or cyclic alkyl groups such as methyl, ethyl, isopropyl, t-butyl and cyclohexyl, and ones each having 1 to 25 carbon atoms are suitably used.

When $R_6$ and $R_7$ represent substituted or unsubstituted aryl groups, the aryl groups include carbocyclic aryl groups and heterocyclic aryl groups. As the carbocyclic aryl groups, ones each having 6 to 19 carbon atoms, such as phenyl, naphthyl, anthracenyl and pyrenyl, are used. As the heterocyclic aryl groups, ones each having 3 to 20 carbon atoms and 1 to 5 heteroatoms, such as pyridyl, furyl, quinolyl obtained by cyclocondensation of a benzene ring, benzofuryl, thioxanthone and carbazole, are used.

When $R_6$ and $R_7$ are substituted alkyl groups or substituted aryl groups, the substituents include alkoxyl groups each having 1 to 10 carbon atoms such as methoxy and ethoxy; halogen atoms such as fluorine, chlorine and bromine; halogensubstituted alkyl groups such as trifluoromethyl and trichloromethyl; alkoxycarbonyl or aryloxycarbonyl groups each having 2 to 15 carbon atoms such as methoxycarbonyl, ethoxycarbonyl, t-butyloxycarbonyl and p-chlorophenyloxycarbonyl; hydroxyl; acyloxy groups such as acetyloxy, benzoyloxy and p-diphenylaminobenzoyloxy; carbonate groups such as t-butyloxycarbonyloxy; ether groups such as t-butyloxycarbonylmethyloxy and 2-pyranyloxy; substituted or unsubstituted amino groups such as amino, dimethylamino, diphenylamino, morpholino and acetylamino; thioether groups such as methylthio and phenylthio; alkenyl groups such as vinyl and styryl; nitro; cyano; acyl-groups such as formyl, acetyl and benzoyl; aryl groups such as phenyl and naphthyl; and heteroaryl such as pyridyl.

Further, when $R_6$ and $R_7$ are substituted aryl groups, alkyl groups such as methyl and ethyl can be used as the substituents, in addition to the above-mentioned substituents.

As $R_6$ and $R_7$ described above, substituted or unsubstituted alkyl groups are preferred in terms of excellent storage stability of the printing plates, and secondary alkyl groups substituted by electron attractive groups such as alkoxyl, carbonyl, alkoxycarbonyl, cyano and halogen, or secondary alkyl groups such as cyclohexyl and norbonyl are particularly preferred in terms of storage stability. Compounds in which the chemical shift of the secondary methine hydrogen in the proton NMR in deutero chloroform appears in a magnetic field lower than 4.4 ppm, and compounds in which the chemical shift appears in a magnetic field lower than 4.6 ppm are more preferred.

The reason why the secondary alkyl groups substituted by electron attractive groups are thus particularly preferred is considered that carbocations which seem to be produced as intermediates in the thermal decomposition reaction are unstabilized by the electron attractive groups to inhibit the decomposition.

Specifically, it is particularly preferred that —$CHR^6R^7$ has structures represented by the following formulas:

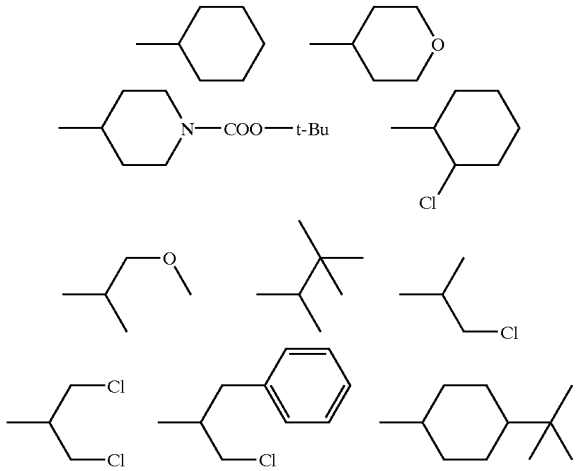

-continued

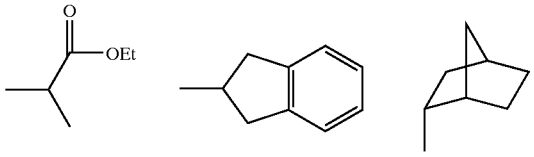

In formula (6), L has the same meaning as given for formulas (1) to (5).

Specific examples of monomers having the functional groups represented byformulas (1) to (5) and usedin synthesis of the polarity converting polymers contained in the recording layers of the heat-sensitive lithographic printing plates of the invention are shown below:

(1)

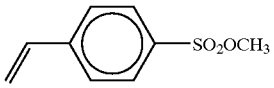

(2)

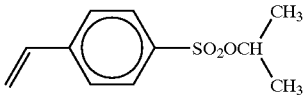

(3)

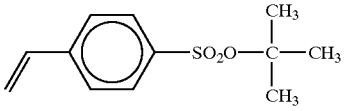

(4)

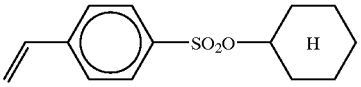

(5)

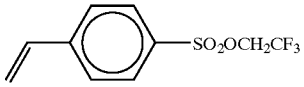

(6)

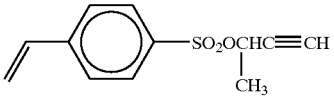

(7)

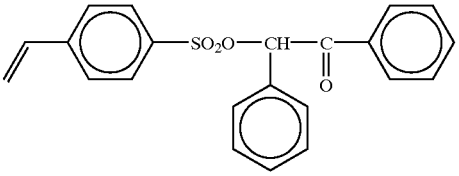

(8)

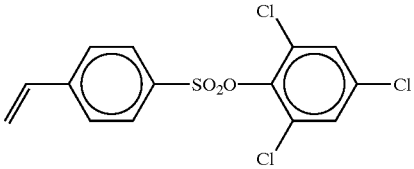

(9)

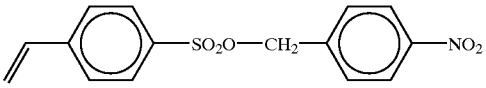

-continued
(10)
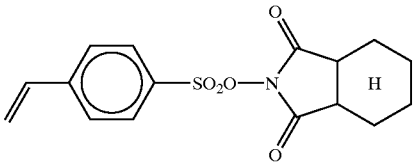
(11)
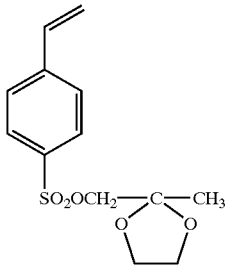
(12)
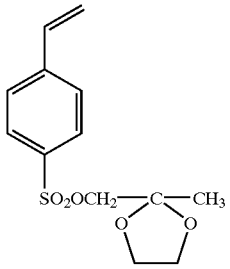
(13)
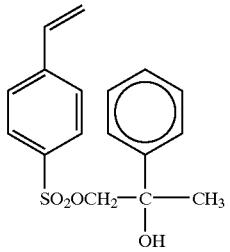
(14)
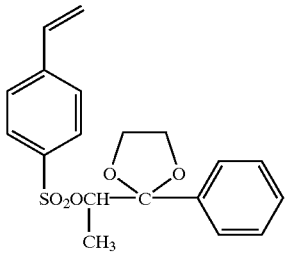
(15)
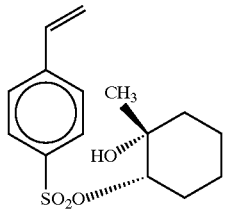
-continued
(16)
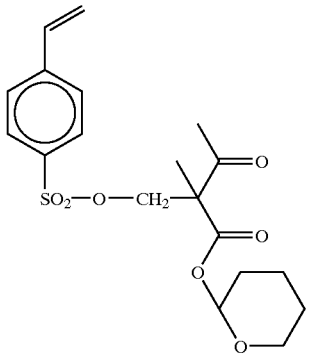
(17)
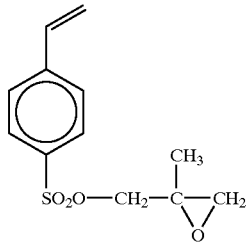
(18)
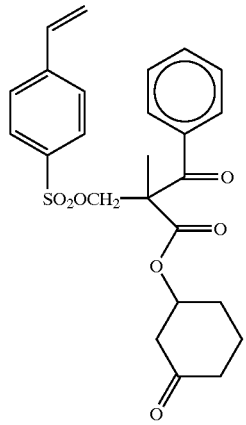
(19)
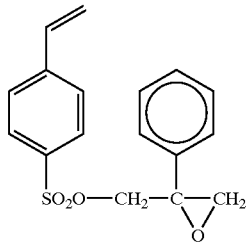
(20)
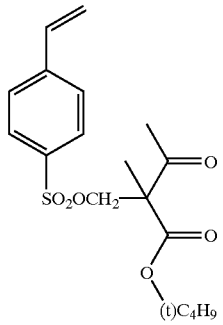

-continued
(21)
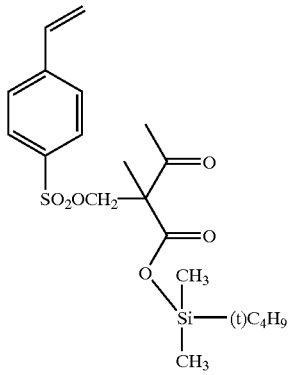
(22)
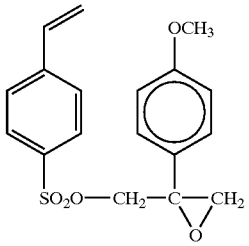
(23)
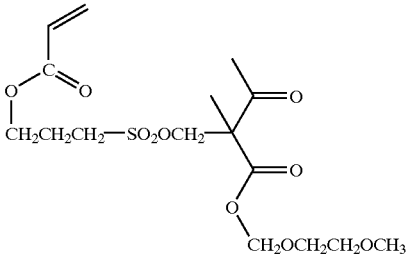
(24)
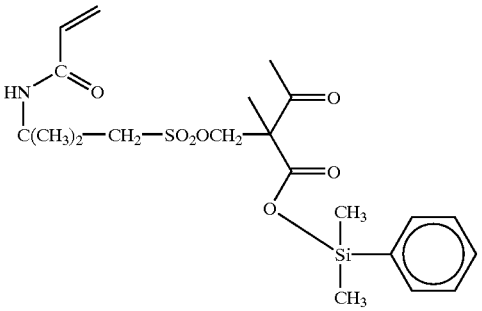
(25)
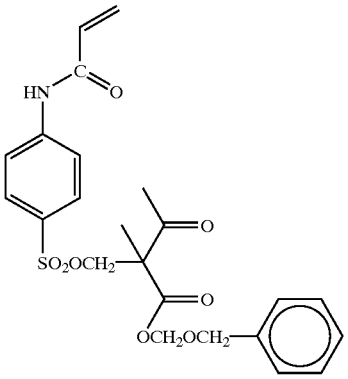
-continued
(26)
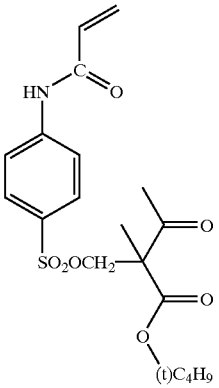
(27)
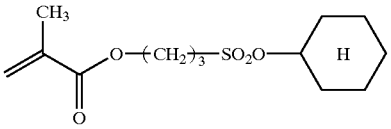
(28)
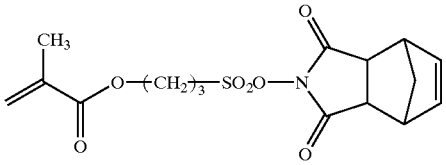
(29)
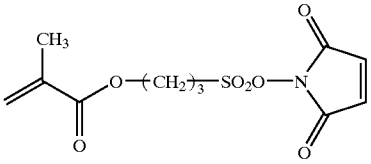
(30)
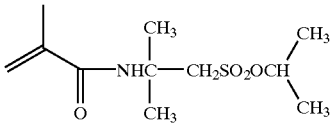
(31)
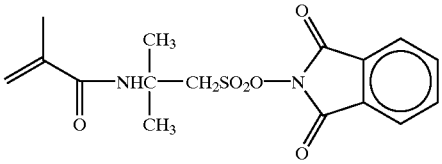
(32)
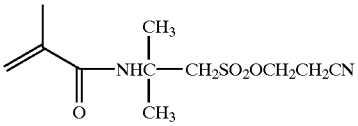
(33)
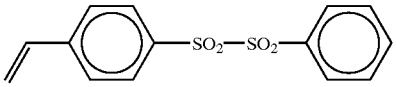
(34)
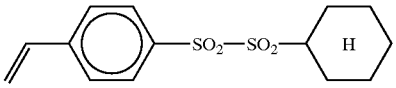

-continued
(35)
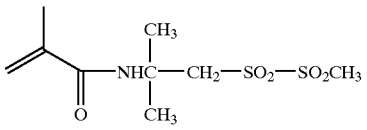
(36)
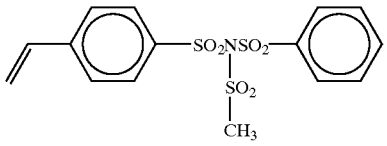
(37)
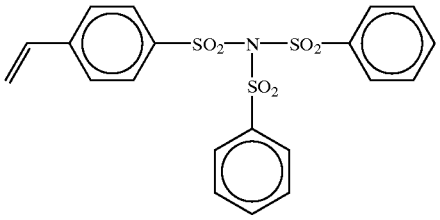
(38)
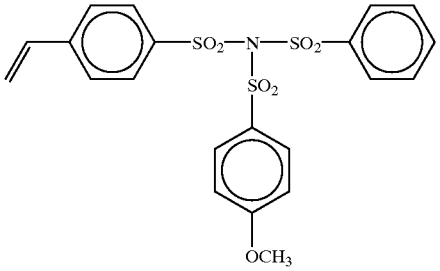
(39)
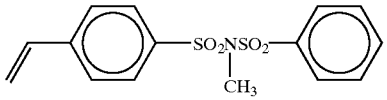
(40)
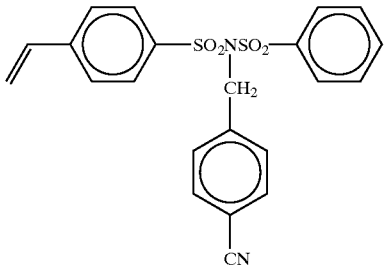
(41)
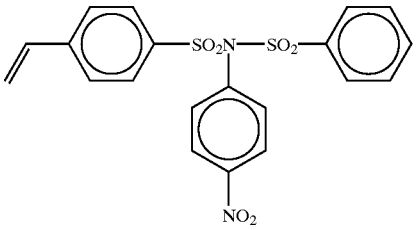
(42)
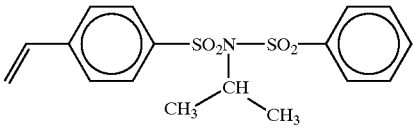
-continued
(43)
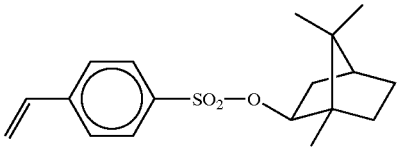
(44)
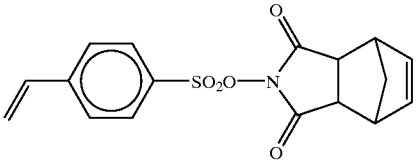
(45)
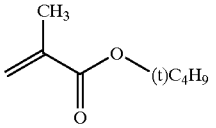
(46)
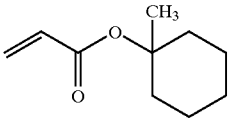
(47)
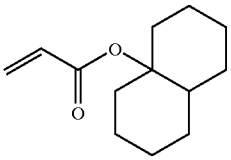
(48)
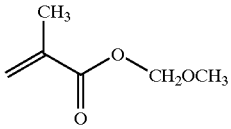
(49)
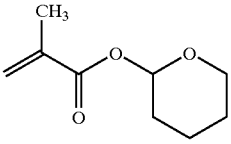
(50)
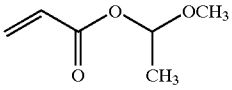
(51)
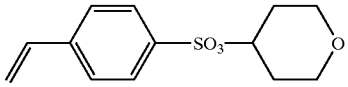
(52)
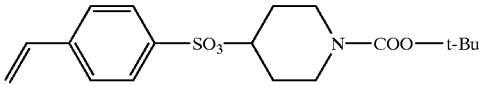
(53)
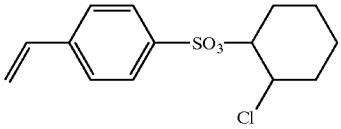
(54)
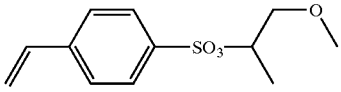

-continued (55)

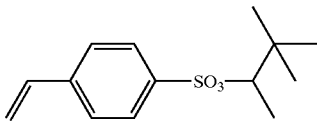

(56)

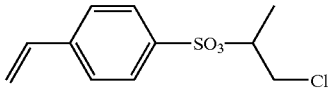

(57)

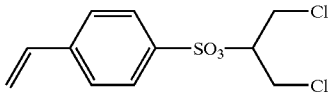

(58)

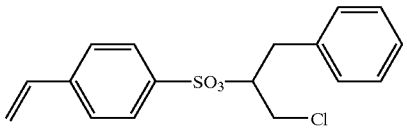

(59)

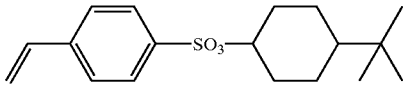

(60)

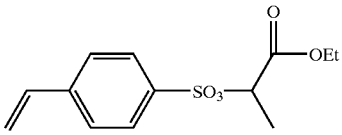

(61)

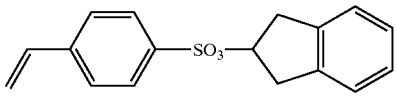

(62)

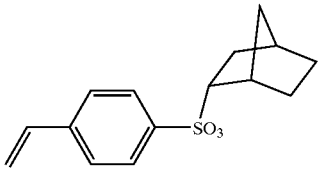

In the invention, the polarity converting polymers are used which are obtained by radical polymerization using at least one selected from the monomers having the functional groups represented by formulas (1) to (5). As such polymers, homopolymers may be used in which only one kind of monomer selected from the monomers having the functional groups represented by formulas (1) to (5) is used, but copolymers using two or more of them or copolymers of these monomers with other monomers may also be used.

In the invention, the polarity converting polymers more preferably used are copolymers obtained by radical polymerization of the above-mentioned monomers with other known monomers.

The other monomers used in the copolymers include, for example, known monomers such as acrylates, methacrylates, acrylamide derivatives, methacrylamide derivatives, vinyl esters, styrene derivatives, acrylic acid, methacrylic acid, acrylonitrile, maleic anhydride and maleimide.

Specific examples of the acrylates include methyl acrylate, ethyl acrylate, n-or i-propyl acrylate, n-, i-, sec- or t-butyl acrylate, amyl acrylate, 2-ethylhexyl acrylate, dodecyl acrylate, chloroethyl acrylate, 2-hydroxyethyl acrylate, 2-hydroxypropyl acrylate, 5-hydroxypentyl acrylate, cyclohexyl acrylate, allyl acrylate, trimethylolpropane monoacrylate, pentaerythritol monoacrylate, benzyl acrylate, methoxybenzyl acrylate, chlorobenzyl acrylate, hydroxybenzyl acrylate, hydroxyphenethyl acrylate, dihydroxyphenethyl acrylate, furfuryl acrylate, tetrahydrofurfuryl acrylate, phenyl acrylate, hydroxyphenyl acrylate, chlorophenyl acrylate, sulfamoylphenyl acrylate and 2-(hydroxyphenyl-carbonyloxy)ethyl acrylate.

Specific examples of the methacrylates include methyl methacrylate, ethyl methacrylate, n- or i-propyl methacrylate, n-, i-, sec- or t-butyl methacrylate, amyl methacrylate, 2-ethylhexyl methacrylate, dodecyl methacrylate, chloroethyl methacrylate, 2-hydroxyethyl methacrylate, 2-hydroxypropyl methacrylate, 5-hydroxypentyl methacrylate, cyclohexyl methacrylate, allyl methacrylate, trimethylolpropane monomethacrylate, pentaerythritol monomethacrylate, glycidyl methacrylate, benzyl methacrylate, methoxybenzyl methacrylate, chlorobenzyl methacrylate, hydroxybenzyl methacrylate, hydroxyphenethyl methacrylate, dihydroxyphenethyl methacrylate, furfuryl methacrylate, tetrahydrofurfuryl methacrylate, phenyl methacrylate, hydroxyphenyl methacrylate, chlorophenyl methacrylate, sulfamoylphenyl methacrylate and 2-(hydroxyphenylcarbonyloxy) ethyl methacrylate.

Specific examples of the acrylamide derivatives include acrylamide, N-methylacrylamide, N-ethylacrylamide, N-propylacrylamide, N-butylacrylamide, N-benzylacrylamide, N-hydroxyethylacrylamide, N-phenylacrylamide, N-tolylacrylamide, N-(hydroxyphenyl)acrylamide, N-(sulfamoylphenyl) acrylamide, N-(phenylsulfonyl)acrylamide, N-(tolylsulfonyl)acrylamide, N,N-dimethylacrylamide, N-methyl-N-phenylacrylamide and N-hydroxyethyl-N-methylacrylamide.

Specific examples of the methacrylamide derivatives include methacrylamide, N-methylmethacrylamide, N-ethylmethacrylamide, N-propylmethacrylamide, N-butylmethacrylamide, N-benzylmethacrylamide, N-hydroxyethylmethacrylamide, N-phenylmethacrylamide, N-tolylmethacrylamide, N-(hydroxyphenyl) methacrylamide, N-(sulfamoylphenyl)methacrylamide, N-(phenylsulfonyl)methacrylamide, N-(tolylsulfonyl) methacrylamide, N,N-dimethylmethacrylamide, N-methyl-N-phenylmethacrylamide and N-hydroxyethyl-N-methylmethacrylamide.

Specific examples of the vinyl esters include vinyl acetate, vinyl butyrate and vinyl benzoate.

Specific examples of the styrene derivatives include styrene, methylstyrene, dimethylstyrene, trimethylstyrene, ethylstyrene, propylstyrene, cyclohexylstyrene, chloromethylstyrene, trifluoromethylstyrene, ethoxymethylstyrene, acetoxymethylstyrene, methoxystyrene, dimethoxystyrene, chlorostyrene, dichlorostyrene, bromostyrene, iodostyrene, fluorostyrene and carboxystyrene.

Of these other monomers, particularly preferably used are the acrylates, the methacrylates, the acrylamide derivatives, the methacrylamide derivatives, the vinyl esters, the styrene derivatives, acrylic acid, methacrylic acid and acrylonitrile, each having 20 or less carbon atoms.

The ratio of the monomers having the functional groups represented by formulas (1) to (5) used in the synthesis of the copolymers is preferably from 5% to 99% by weight, and more preferably from 10% to 95% by weight.

Specific examples of the polarity converting polymers having the functional groups represented by formulas (1) to (5) are shown below:
(1)
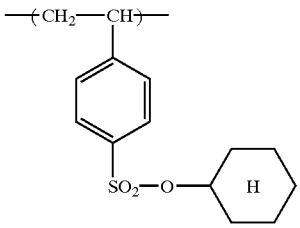
(2)
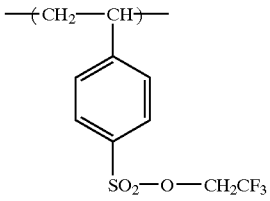
(3)
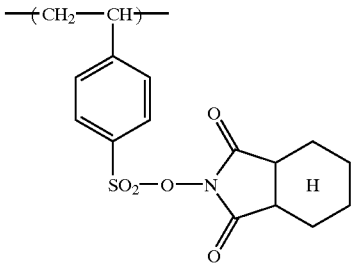
(4)
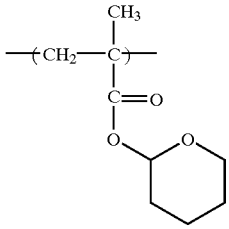
(5)
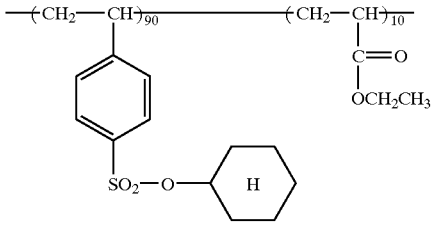
(6)
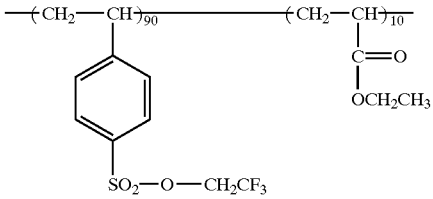
-continued
(7)
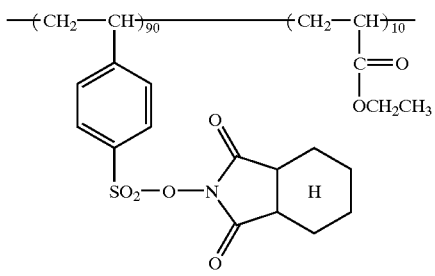
(8)
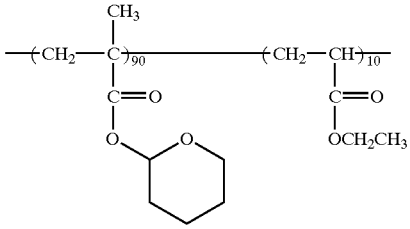
(9)
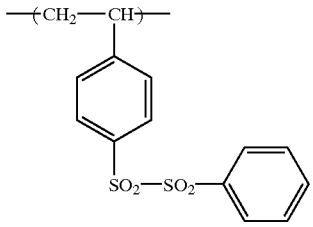
(10)
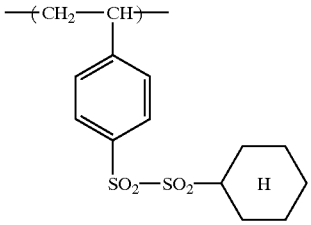
(11)
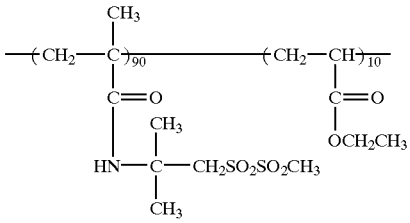
(12)
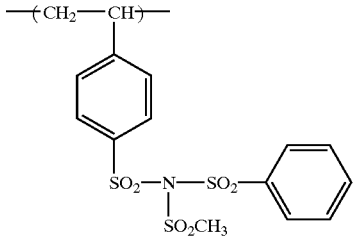

-continued
(13)
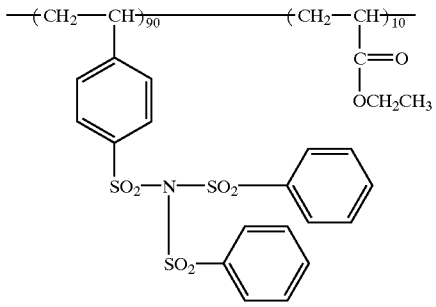
(14)
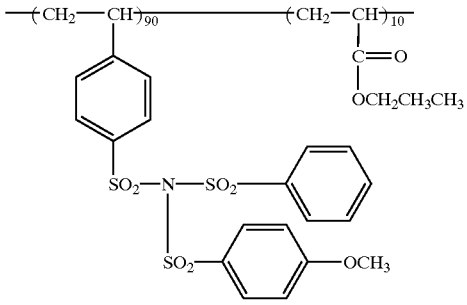
(15)
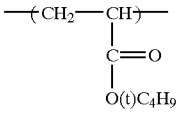
(16)
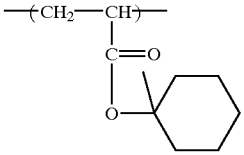
(17)
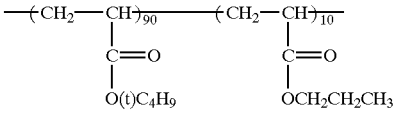
(18)
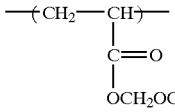
(19)
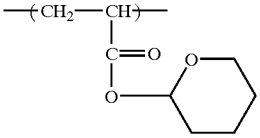
(20)
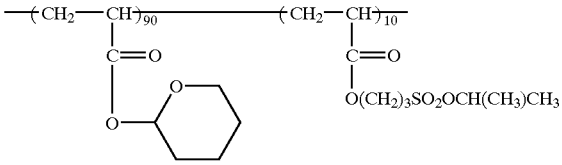
(21)
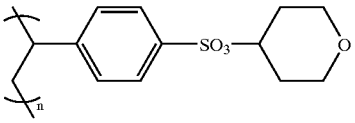
-continued
(22)
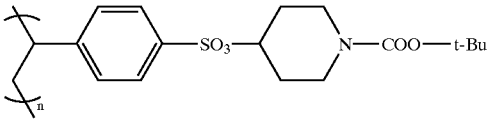
(23)
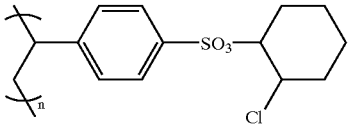
(24)
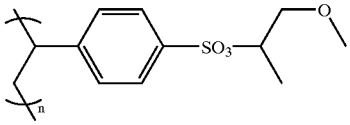
(25)
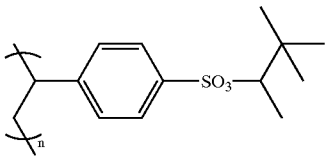
(26)
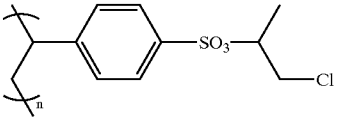
(27)
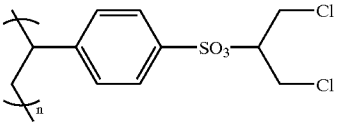
(28)
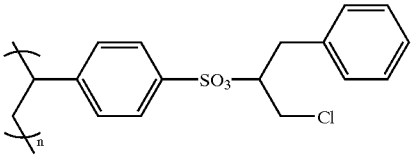
(29)
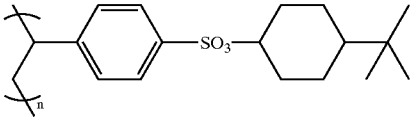
(30)
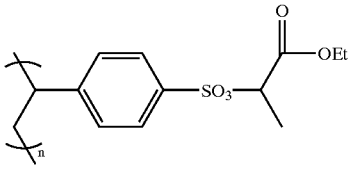
(31)
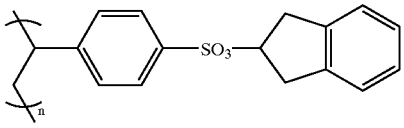

-continued (32)

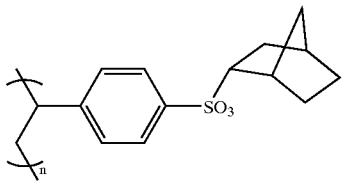

In the formulas, the numerals and n indicate the molar number of composition unit in polymers.

The weight average molecular weight of the polarity converting polymers having at least one of the functional groups represented by formulas (1) to (5), which are used in the invention, is preferably 2000 or more, and more preferably within the range of 5,000 to 300,000. The number average molecular weight thereof is preferably 800 or more, and more preferably within the range of 1,000 to 250,000. The polydisperse degree (weight average molecular weight/number average molecular weight) is preferably 1 or more, and more preferably within the range of 1.1 to 10. Although these polymers may be any of random copolymers, block copolymers and graft copolymers, they are preferably random copolymers.

In the next place, the image-forming layer containing a hydrophilic polymer in which a side chain changes to hydrophobic by heat provided on the hydrophilic insulating layer or the hydrophilic crosslinked insulating layer of the lithographic printing plate precursor according to the present invention will be described below.

The hydrophilic polymers for use in the image-forming layer according to the present invention are not particularly limited so long as they are polymers having any group selected from the group consisting of carboxylic acid groups or carboxylate groups which cause decarboxylation by heat, but is preferably at least any selected from those represented by the following formula (2) or (3):

(2)

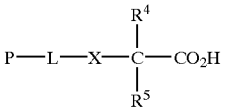

(3)

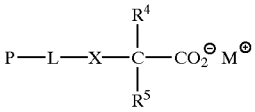

wherein X is selected from the group consisting of elements of group IV to group VI, oxides of the above elements, sulfides of the above elements, selenium compounds of the above elements, and tellurium compounds of the above elements; P represents a polymer main chain; —L— represents a divalent linking group; $R^4$ and $R^5$, which may be the same or different, each represents a monovalent group; and M is selected from the group consisting of alkali metal, alkaline earth metal and onium.

Specific examples of the polymers having any group selected from the group consisting of carboxylic acid groups or carboxylate groups which cause decarboxylation by heat according to the present invention are shown below.

(1)

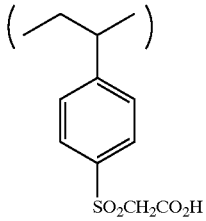

(2)

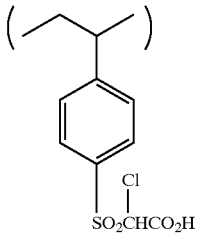

(3)

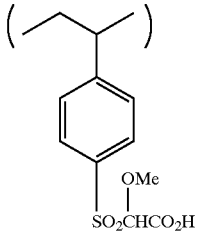

(4)

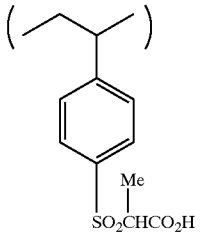

(5)

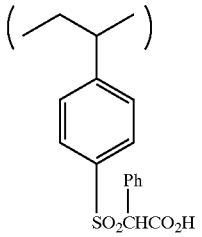

(6)

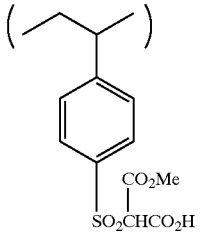

(7)

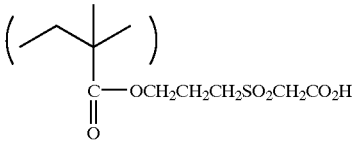

-continued (8)

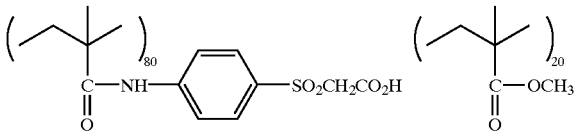

When the polarity converting polymers contained in the recording layers of the heat-sensitive lithographic printing plates of the invention are synthesized, solvents such as tetrahydrofuran and ethylene dichloride can be used alone or as a mixture of two or more of them.

The radical polymerization initiators used in synthesizing the polarity converting polymers include known compounds such as azo initiators and peroxide initiators.

In the heat-sensitive lithographic printing plates of the invention, the recording layers may be composed of either the polarity converting polymers alone or the polymers and other components as needed, within the range that the effects of the invention are not impaired. In the recording layer, the polymer can be used in an amount of 50% to 90% by weight, preferably 70% to 90% by weight, based on the total solid content of the recording layer. An amount added of less than 50% by weight results in unclear printed images, whereas exceeding 90% by weight results in insufficient image formation by laser exposure.

Other various components may be added to the recording layers. For example, dyes having high absorption in the visible light region can be used as coloring agents for images.

Specific examples of the dyes include Oil Yellow #101, Oil Yellow #103, Oil Pink #312, Oil Green BG, Oil Blue BOS, Oil Blue #603, Oil Black BY, Oil Black BS, Oil Black T-505 (the above dyes are manufactured by Orient Kagaku Kogyo Co., Ltd.); Victoria Pure Blue, Crystal Violet (CI 42555), Methyl Violet (CI 42535), Ethyl Violet, Rhodamine B (CI 145170B), Malachite Green (CI 42000), Methylene Blue (CI 52015) and dyes described in JP-A-62-293247.

These dyes discolor after laser exposure, so that image areas are easily distinguished from non-image areas. Accordingly, they are preferably added. The amount thereof added is from 0.01% to 10% by weight, based on the total solid content of materials for the recording layer.

Further, the recording layers used in the invention can contain nonionic surfactants as described in JP-A-62-251740 and JP-A-3-208514, or amphoteric surfactants as described in JP-A-59-121044 and JP-A-4-13149, for widening stability to printing conditions.

Specific examples of the nonionic surfactants include sorbitan tristearate, sorbitan monopalmitate, sorbitan trioleate, stearic monoglyceride and polyoxyethylenenonyl phenyl ether.

Specific examples of the amphoteric surfactants include alkyldi(aminoethyl)glycines, alkylpolyaminoethylglycine hydrochlorides, 2-alkyl-N-carboxyethyl-N-hydroxyethylimidazoliumbetaines and N-tetradecyl-N,N-betaine (for example, trade name "Amogen K" manufactured by Dai-ich Kogyo K.K.).

The amount of the nonionic surfactants and the amphoteric surfactants contained in the materials for the recording layers is preferably from 0.05% to 15% by weight, and more preferably from 0.1% to 5% by weight.

Further, the recording layers used in the invention may contain plasticizers for imparting flexibility to coating films. For example, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, and oligomers and polymers of acrylic acid or methacrylic acid are used.

In addition to these, epoxy compounds, vinyl ethers, hydroxymethyl group-containing phenol compounds described in JP-A-8-276558 and alkoxymethyl group-containing phenol compounds may be added. Further, for improving the strength of coating films, other polymers may be added.

The recording layers of the heat-sensitive lithographic printing plates of the invention can usually be provided by applying solutions of the above-mentioned respective components in solvents onto the crosslinked hydrophilic layers described above. Examples of the solvents used herein include but are not limited to ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethyl sulfoxide, sulfolane, γ-butyrolactone, toluene and water.

These solvents may be used alone or in combination. The concentration of the components (the total solids including additives) dissolved in the solvents is preferably from 1% to 50% by weight. In general, the amount of the components (solids) on the supports after coating and drying is preferably from 0.5 $g/m^2$ to 5.0 $g/m^2$ for the heat-sensitive lithographic printing plates, although it varies depending on the application thereof. The solutions can be applied by various methods, and examples thereof include bar coater coating, rotational coating, spray coating, curtain coating, dip coating, air knife coating blade coating and roll coating.

The recording layers of the heat-sensitive lithographic printing plates of the invention can contain surfactants for improving coating properties, for example, fluorine surfactants as described in JP-A-62-170950. The amount of the surfactant added is preferably from 0.01% to 1% by weight, and more preferably from 0.05% to 0.5% by weight, based on the total solid content of the materials for the recording layer.

Light-Heat Converting Agent

When the heat-sensitive lithographic printing plate of the invention is subjected to image formation by laser exposure, at least one of the crosslinked hydrophilic layer and recording layer thereof is allowed to contain a light-heat converting agent. As the light-heat converting agents, all materials can be used, as long as they can absorb light rays such as ultraviolet rays, visible light rays, infrared rays and white light rays to convert them to heat. Examples thereof include carbon black, carbon graphite, pigments, phthalocyanine pigments, metal powders and metal compound powders. Particularly preferred are dyes and pigments effectively absorbing infrared rays having a wavelength of 760 nm to 1,200 nm, or metal powders and metal compound powders.

As the dyes, commercial dyes and known dyes described in literatures (for example, *Senryo Binran*, edited by Yuki Gosei Kagaku Kyokai, 1970) can be utilized. Specific examples thereof include azo dyes, metal complex dyes, pyrazolone azo dyes, anthraquinone dyes, phthalocyanine dyes, carbonium dyes, quinoneimine dyes, methine dyes, cyanine dyes and metal thiolate complexes.

Preferred examples of the dyes include cyanine dyes described in JP-A-58-125246, JP-A-59-84356, JP-A-59-202829 and JP-A-60-78787, methine dyes described in JP-A-58-173696, JP-A-58-181690 and JP-A-58-194595, naphthoquinone dyes described in JP-A-58-112793, JP-A-58-224793, JP-A-59-48187, JP-A-59-73996, JP-A-60-52940 and JP-A-60-63744, squarylium dyes described in JP-A-58-112792 and cyanine dyes described in British Patent 434,875.

Further, near infrared absorption sensitizers described in U.S. Pat. No. 5,156,938 arealsopreferably used. Inaddition, substituted arylbenzo(thio)pyrylium salts described in U.S. Pat. No. 3,881,924, trimethinethiapyrylium salts described in JP-A-57-142645 (U.S. Pat. No. 4,327,169), pyrylium compounds described in JP-A-58-181051, JP-A-58-220143, JP-A-59-41363, JP-A-59-84248, JP-A-59-84249, JP-A-59-146063 and JP-A-59-146061, cyanine dyes described in JP-A-59-216149, pentamethinethiopyrylium salts described in U.S. Pat. No. 4,283,475 and pyrylium compounds described in JP-B-5-13514 (the term "JP-B" as used herein means an "examined Japanese patent publication") and JP-B-5-19702 are also preferably used.

Other preferred examples of the dyes include near infrared absorption dyes represented by formulas (I) and (II) in U.S. Pat. No. 4,756,993.

Of these dyes, particularly preferred are cyanine dyes, squarylium dyes, pyrylium dyes and nickel thiolate complexes.

The pigments used in the invention are commercial pigments and pigments described in *Color Index* (*C. I*) *Binran, Saishin Ganryo Binran* (edited by Nippon Ganryo Gijutsu Kyokai, 1977), *Saishin Ganryo Oyo Gijutsu* (CMC Shuppan, 1986) and *Insatsu Ink Gijutsu* (CMC Shuppan, 1984).

As the kind of pigment, there are black pigments, yellow pigments, orange pigments, brown pigments, red pigments, purple pigments, blue pigments, green pigments, fluorescent pigments, metal powder pigments and polymer binding dyes. Specifically, examples of the dyes which can be used include insoluble azo pigments, azo lake pigments, condensed azo pigments, chelate azo pigments, phthalocyanine pigments, anthraquinone pigments, perylene and perynone pigments, thioindigo pigments, quinacridone pigments, dioxazine pigments, isoindolinone pigments, quinophthalone pigments, lake dye pigments, azine pigments, nitroso pigments, nitro pigments, natural pigments, fluorescent pigments, inorganic pigments and carbon black. Of these pigments, preferred is carbon black.

These pigments may be surface treated to use them, or used without surface treatment. Possible surface treatment methods include methods of coating surfaces of the pigments with resins or wax, methods of adhering surfactants to surfaces of the pigments, and methods of combining reactive substances (for example, silane coupling agents, epoxy compounds and polyisocyanates) with surfaces of the pigments. The above-mentioned surface treatment methods are described in *Kinzoku Sekken no Seishitsu to Oyo* (Saiwai Shobo), *Insatsu Ink Gijutsu* (CMC Shuppan, 1984) and *Saishin Ganryo Oyo Gijutsu* (CMC Shuppan, 1986).

The particle size of the pigments is preferably within the range of 0.01 $\mu$m 10 $\mu$m, more preferably within the range of 0.05 $\mu$muto 1 $\mu$m, and particularly preferably within the range of 0.1 $\mu$m to 1 $\mu$m. When the particle size of the pigments is less than 0.01 $\mu$m, the stability of dispersed particles in coating solutions for the recording layers becomes unfavorable. On the other hand, exceeding 10 $\mu$m results in unfavorable uniformity of the recording layers.

As methods for dispersing the pigments, known dispersing techniques used in the production of ink or toner can be used. Dispersing apparatus include ultrasonic dispersers, sand mills, attriters, pearl mills, super mills, ball mills, impellers, dispersers, KD mills, colloid mills, dynatrons, three-roll mills and pressure kneaders. Details thereof are described in *Saishin Ganryo Oyo Gijutsu* (CMC Shuppan, 1986).

The metal powders and the metal compound powders are described below. The metal compounds include specifically metal oxides, metal nitrides, metal sulfides and metal carbides.

The metals include Mg, Al, Si, Ti, V, Cr, Mn, Fe, Co, Ni, Cu, Zn, Ga, Ge, Y, Zr, Nb, Mo, Tc, Ru, Pd, Ag, Cd, In, Sn, Sb, Hf, Ta, W, Re, Os, Ir, Pt, Au and Pb. Of these, the metals which particularly easily bring about the exothermic reaction such as the oxidation reaction by heat energy are preferred, and preferred examples thereof include Al, Si, Ti, V, Cr, Mn, Fe, Co, Ni, Cu, Zn, Y, Zr, Mo, Ag, In, Sn and W. Further, as the metals high in the absorption efficiency of radiant rays and high in heat energy of the self-exothermic reaction, Fe, Co, Ni, Cr, Ti and Zr are preferred.

The powder may be composed of not only one kind of metal simple substance selected from these metals, but also two or more kinds of them. Further, the powder may be composed of a combination of the metal and the metal oxide, the metal nitride, the metal sulfide or the metal carbide. The metal simple substances are higher in heat energy of the self-exothermic reaction such as oxidation. However, handling thereof in air is complicated, and the contact thereof with air results in danger of spontaneous ignition. It is therefore preferred that the metal simple substances are coated with the oxides, the nitrides, the sulfides or the carbides to a thickness of several nanometers from surfaces thereof.

Further, they may be used either in the particle form, or in the thin film form such as vapor-deposited films. When they are used in combination with organic materials, it is better to use them in the particle form. The size of the particles is 10 $\mu$m or less, preferably from 0.005 $\mu$m to 5 $\mu$m, and more preferably, from 0.01 $\mu$m to 3 $\mu$m. Less than 0.01 $\mu$m causes difficulty in dispersing the particles, whereas exceeding 10 $\mu$m results in poor resolution of printed matter.

Of the above-mentioned fine metal powders used in the invention, iron powders are preferred. Although the iron powders are all preferred, iron alloy powders mainly composed of $\alpha$-Fe are particularly preferred among others. These powders may contain atoms such as Al, Si, S, Sc, Ca, Ti, V, Cr, Cu, Y, Mo, Rh, Pd, Ag, Sn, Sb, Te, Ba, Ta, W, Re, Au, Hg, Pb, Bi, La, Ce, Pr, Nd, P, Co, Mn, Zn, Ni, Sr and B, in addition to the specified atoms. In particular, it is preferred that the powders contain at least one of Al, Si, Ca, Y, Ba, La, Nd, Co, Ni and B, in addition to $\alpha$-Fe, and it is more preferred that the powders contain at least one of Co, Y and Al. The Co content is preferably from 0 atomic percent to 40 atomic percent, more preferably from 15 atomic percent to 35 atomic percent, and still more preferably from 20 atomic percent to 35 atomic percent, based on Fe. The Y content is preferably from 1.5 atomic percent to 12 atomic percent, more preferably from 3 atomic percent to 10 atomic percent, and still more preferably from 4 atomic percent to 9 atomic percent. The Al content is preferably from 1.5 atomic percent to 12 atomic percent, more preferably from 3 atomic percent to 10 atomic percent, and still more preferably from 4 atomic percent to 9 atomic percent. The fine iron alloy powders may contain small amounts of hydroxides or oxides. Details thereof are described in JP-B-44-14090, JP-B-45-18372, JP-B-47-22062, JP-B-47-22513, JP-B-46-28466, JP-B-46-38755, JP-B-47-4286, JP-B-47-12422, JP-B-47-17284, JP-B-47-18509, JP-B-47-18573, JP-B-39-10307, JP-B-46-39639, U.S. Pat. Nos. 3,026215, 3,031,341, 3,100,194, 3,242,005 and 3,389,014.

These light-heat converting materials can be used in an amount of 0.01% to 50% by weight, preferably 0.1% to 10% by weight, based on the crosslinked hydrophilic layer or the total solid content of the recording layer. The dyes can be used particularly preferably in an amount of 0.5% to 10% by weight, and the pigments can be particularly preferably used in an amount of 3.1% to 10% by weight. When the amount of the pigments or dyes added is less than 0.01% by weight, the sensitivity is lowered. On the other hand, exceeding 50% by weight results in occurrence of stains in non-image areas in printing.

When the light-heat converting materials are used, the density of materials for the crosslinked hydrophilic layers or the recording layers is required to be at least 0.3, preferably 0.5 or more, and more preferably 1.0 or more, in the optical density (OD) at an exposure wavelength. The optical density as used herein shall be a value obtained when compositions of the materials for the crosslinked hydrophilic layers or the recording layers are applied onto transparent supports and measured by transmission.

There is no particular limitation on the supports used in the heat-sensitive lithographic printing plates of the invention, as long as they are dimensionally stable tabular materials. Examples thereof include paper, paper laminated with plastics (for example, polyethylene, polypropylene and polystyrene), plates of metals (for example, aluminum, zinc and copper), films of plastics (for example, cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonates and polyvinyl acetal), and paper or plastic films laminated or vapor deposited with the metals as described above.

As the supports used in the invention, polyester films or aluminum plates are preferred, of these, the aluminum plates, which are good in dimensional stability and relatively inexpensive, are particularly preferred. Preferred examples of the aluminum plates include pure aluminum plates and alloy plates mainly composed of aluminum and containing trace amounts of foreign elements. Further, plastic films laminated or vapor deposited with aluminum are also preferred. The foreign elements contained in the aluminum alloys include silicon, iron, manganese, copper, magnesium, chromium, zinc, bismuth, nickel and titanium. The amount of the foreign elements contained in the alloys is 10% by weight or less. Aluminum particularly preferred in the invention is pure aluminum. However, it is difficult to produce pure aluminum in terms of refining technology, so that aluminum containing the foreign elements in trace amounts is also allowed. As described above, the aluminum plates used in the invention are not specified in their composition, and aluminum plates made of previously known materials can be appropriately utilized. The thickness of the aluminum plates used in the invention is from about 0.1 mm to about 0.6 mm, preferably from 0.15 mm to 0.4 mm, and particularly preferably from 0.2 mm to 0.3 mm.

As described above, the heat-sensitive lithographic printing plates of the invention can be prepared. The heat-sensitive lithographic printing plates are exposed imagewise with a solid laser or a semiconductor laser emitting an infrared ray having a wavelength of 760 nm to 1,200 nm, or heated imagewise with a thermal (heat-sensitive) head to form images. In the invention, it is unnecessary to conduct the dissolution treatment, and it becomes possible to mount the printing plates on a printing machine immediately after the laser irradiation or the thermal head heating, and to perform printing. It becomes therefore unnecessary to conduct the reheating treatment between the stage such as the laser irradiation or the thermal head heating and the printing stage. Such heat-sensitive lithographic printing plates on which images are recorded are placed on an offset printing machine (i.e., an offset printing press), and used for printing of many sheets.

EXAMPLE

The invention will be further illustrated in greater detail with reference to the following examples, which are, however, not to be construed as limiting the invention.

Examples I-1 to I-12

Preparation of Crosslinked Hydrophilic Layers

Respective crosslinked hydrophilic layers were formed on respective supports as follows.

(1) Hydrophilic Layer A (Hydrophilic Layer Composed of Crosslinked Polymer Containing Metal Colloid)

A solution in which 200 g of colloidal silica (Snowtex R503, a 20-wt % aqueous dispersion, manufactured by Nissan Chemical Industries, Ltd.) and 5 g of aminopropyltriethoxysilane were mixed, was applied onto a corona-treated PET support having a thickness of 200 μm with a wire bar 18, and dried at 100° C. for 10 minutes, thereby obtaining a crosslinked hydrophilic layer having a thickness of 4 μm.

(2) Hydrophilic Layer B (Hydrophilic Layer Composed of Condensate of Organic Hydrophilic Polymer and Silane Coupling Agent)

Fifty grams of titanium oxide having a particle size of 0.3 μm (manufactured by Titan Kogyo K.K.), 113 g of a 10% aqueous solution of polyvinyl alcohol (PVA 117, manufactured by Kuraray Co., Ltd.) and 240 g of water were dispersed together with glass beads in a paint shaker (manufactured by Toyo Seiki Co., Ltd.) for 30 minutes. Further, 110 g of a 20% solution (water/ethanol ratio: 1/1 by weight) of previously hydrolyzed tetraethoxysilane and 200 g of colloidal silica (Snowtex R503, a 20-wt % aqueous dispersion, manufactured by Nissan Chemical Industries, Ltd.) were added thereto, and dispersed for 3 minutes, followed by separation of the glass beads by filtration to obtain a dispersion. Then, the dispersion was applied onto a corona-treated PET support having a thickness of 200 μm with a wire bar 18, and dried at 100° C. for 10 minutes, thereby obtaining a crosslinked hydrophilic layer having a thickness of 4 μm.

(3) Hydrophilic Layer C (Hydrophilic Layer Composed of Condensate of Organic Hydrophilic Polymer and Silane Coupling Agent)

A crosslinked hydrophilic layer was prepared in the same manner as with the above-mentioned hydrophilic layer B with the exception that an iron alloy fine particle powder having a Fe:Co:Al:Y ratio of 100:20:5:5, a length in the long axis of 0.1 μm and a length in the short axis of 0.02 μm for the particle size, and a specific surface area of 60 $m^2/g$ was used in place of titanium oxide.

(4) Hydrophilic Layer D (Hydrophilic Layer Composed of Crosslinked Organic Polymer)

Production Example of Hydrophilic Polymer

In dimethylacetamide, 18.0 g of polyacrylic acid having a molecular weight of 25,000 (manufactured by Wako Pure Chemical Industries Ltd.) was dissolved, and 5.5 g of 2-methacryloyloxyethyl isocyanate (hereinafter briefly referred to as "MOI") and 0.1 g of dibutyltin dilaurate were added thereto, followed by reaction for 3 hours. Then, 80 equivalent percent of carboxyl groups were partially neutralized with sodium hydroxide, and acetone was added thereto to precipitate a polymer. The polymer was thoroughly washed to purify it, thus obtaining hydrophilic polymer P-1.

Then, 1.0 g of polymer P-1 described above, 0.1 g of water-soluble triazine initiator A described below and 2.0 g of polyethylene glycol diarylate (A600, manufactured by Toa Gosei Co., Ltd.) were dissolved in 20 g of water. The resulting solution was applied onto a 200-$\mu$m thick aluminum plate with a wire bar 14, and dried at 100° C. for 1 minute. The whole surface thereof is exposed to UV light (1000 counts) [an Eye rotary printer, manufactured by Eye Graphic Co., Ltd.] to obtain a crosslihked hydrophilic layer. The thickness of the hydrophilic layer was 3.5 $\mu$m.

Structure of Water-Soluble Triazine Initiator A:

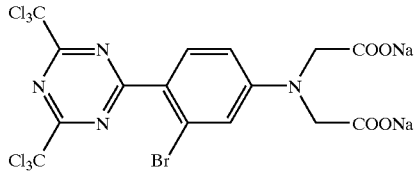

Preparation of Recording Layers

Preparation of Coating Solutions for Recording Layers

Polymers changed in solubility in water by heat and light-heat converting agents were varied as shown in Table 1 to prepare 10 kinds of coating solutions p-1 to p-10 for recording layers. The coating solutions were each applied onto hydrophilic layers A to D described above, respectively, as shown in Table 1, and dried at 80° C. for 3 minutes to obtain heat-sensitive lithographic printing plates 1 to 12. The weight thereof after drying was 1.0 g/m$^2$.

(Coating Solution)

| | |
|---|---|
| Polarity Converting Polymer (see Table I-1) | 4.0 g |
| Light-Heat Converting Agent (see Table I-1) | 0.4 g |
| Fluorine Surfactant (F-177 manufactured by Dainippon Ink & Chemicals, Inc.) | 0.006 g |
| Methyl Ethyl Ketone | 20 g |
| γ-Butyrolactone | 10 g |

(Kind of Light-Heat Converting Agent)

Structure of Light-Heat Converting Agent B:

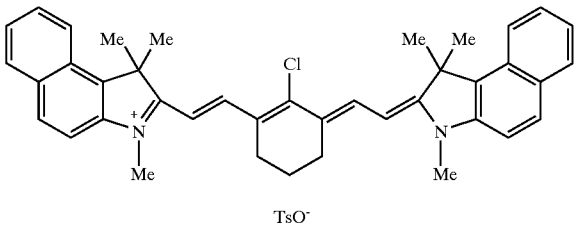

CB: Carbon Black (MHI Black, #5257M, manufactured by Mikuni Sikiso Co., Ltd.)

TABLE I-1

| Example | Heat-Sensitive Lithographic Printing Plate | Cross-linked Hydrophilic Layer | Image Recording Layer: Kind of Coating Solution | Image Recording Layer: Polymer (Specific Example No.) | Image Recording Layer: Light-Heat Converting Agent |
|---|---|---|---|---|---|
| I-1 | 1 | A | p-1 | 1 | Dye B |
| I-2 | 2 | A | p-2 | 24 | Dye B |
| I-3 | 3 | A | p-3 | 24 | CB |
| I-4 | 4 | B | p-4 | 1 | Not added |
| I-5 | 5 | B | p-5 | 24 | Not added |
| I-6 | 6 | B | p-6 | 21 | Not added |
| I-7 | 7 | C | p-2 | 24 | Dye B |
| I-8 | 8 | C | p-7 | 25 | Dye B |
| I-9 | 9 | C | p-8 | 1 | CB |
| I-10 | 10 | D | p-1 | 1 | Dye B |
| I-11 | 11 | D | p-9 | 19 | Dye B |
| I-12 | 12 | D | p-10 | 19 | CB |

(Note: In Examples I-4 to I-6, the hydrophilic layers contain light-heat converting agents.)

(Evaluation of Printing Performance)

The heat-sensitive lithographic printing plates obtained in Examples I-1 to I-12 were exposed imagewise with an LD laser emitting an infrared ray having a wavelength of 830 nm. After exposure, the resulting plates were each mounted on a Hidel SOR-M printing machine as such without development to conduct printing. When 2,000 sheets were printed, all printed sheets were clear, and no stains were observed in non-image areas.

As described above, according to the heat-sensitive lithographic printing plates of the invention, the hydrophilic layers composed of the materials lower in heat sensitivity than aluminum are provided between the supports and the recording layers, which makes it possible to prevent a decrease in the temperature of the recording layers due to the infrared laser exposure and to completely convert the solubility of the polymers contained in the recording layers in water, and which causes the occurrence of stains in printing to be prevented without increasing the exposure amount of a laser. That is to say, the effect of increasing sensitivity is obtained.

Example II

Synthesis Example 3

Synthesis of Hydrophilic Polymer (P-3)

Polyacrylic acid (molecular weight: 25,000, manufactured by Wako Pure Chemical Industries Ltd.) (18.0 g) was dissolved in dimethylacetamide, 5.5 g of 2-methacryloyloxyethylisocyanate (hereinafter abbreviated to MOI) and 0.1 g of dibutyltin dilaurate were added to the above solution and the reaction mixture was allowed to react for 3 hours. Subsequently, 80 equivalent % of the carboxyl group was partially neutralized with sodium hydroxide, acetone was added thereto to precipitate the polymer, the polymer was thoroughly washed and purified, thus hydrophilic Polymer (P-3) was obtained.

Preparation of Hydrophilic Insulating Layer (A-4)

An aluminum plate (material 1050) having a thickness of 0.30 mm was washed with trichloroethylene and degreased, the surface of the aluminum plate was grained with a nylon brush and an aqueous suspension of 400 mesh pumice powder, and thoroughly washed with water. The aluminum plate was immersed in a 25% aqueous solution of sodium hydroxide at 45° C. for 9 seconds to perform etching. After washing with water, the aluminum plate was again immersed in 2% nitric acid for 20 seconds and then washed with water. The amount of aluminum removed from the grained surface by this etching was about 3 g/m$^2$. The plate was then anodized in a 7% sulfuric acid electrolyte at a current density of 15 A/dm$^2$ to provide a direct current anodic oxidation film in an amount of 3 g/m$^2$, and the anodized plate was washed with water and dried.

The following solution (A-4) was coated on the above-treated aluminum plate, dried at 100° C. for 2 minutes, and the entire surface of the plate was exposed to UV ray of 700 count (Eye rotary printer, manufactured by Eye Graphic Co., Ltd.), thus crosslinked hydrophilic layer (A-4) was obtained. The dry coating weight was 1.0 g/m$^2$.

[Solution (A-4)]

| | |
|---|---|
| Hydrophilic Polymer (P-3) | 1.0 g |
| Water-Soluble Triazine Initiator A | 0.1 g |
| Methyl Alcohol | 10.0 g |
| Pure Water | 10.0 g |

Structure of Water-Soluble Triazine Initiator A:

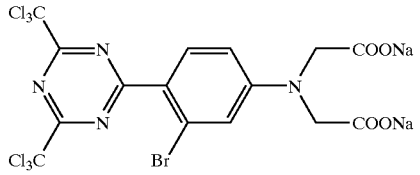

Example II-1

(Preparation of Image-Forming Layer)

Preparation of Coating Solution for Image-Forming Layer:

A coating solution for an image-forming layer was prepared by changing the kinds of a polymer having a carboxylic acid group and a light-heat converting agent respectively shown in Table 2. The coating solution was applied onto the surface of the above hydrophilic insulating layer or hydrophilic crosslinked insulating layer (A-4) as shown in Table 2, and dried at 80° C. for 3 minutes, thereby heat-sensitive lithographic printing plate (B-5) was obtained. Dry weight of the coating solution was 1.0 g/m$^2$.

(Coating Solution)

| | |
|---|---|
| Polymer having a carboxylic acid (see Table 2) | 4.0 g |
| Light-Heat Converting Agent (see Table 2) | 0.4 g |
| Megafac F-177 (fluorine surfactant, manufactured by Dainippon Ink & Chemicals, Inc.) | 0.06 g |
| Methyl Ethyl Ketone | 20.0 g |
| Methyl Alcohol | 7.0 g |

(Kind of Light-Heat Converting Agent)

(1) Structure of Dye A

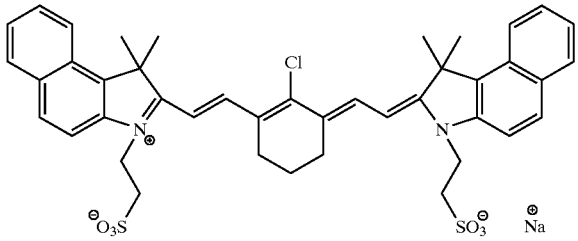

(2) CB: Carbon Black (MHI Black, #5257M, manufactured by Mikuni Sikiso Co., Ltd.)

TABLE 2

| | Heat- | | Image-Forming Layer | |
|---|---|---|---|---|
| Example No. | Sensitive Lithographic Printing Plate | Hydrophilic Insulating Layer | Polymer Having a Carboxylic Acid Group | Light-Heat Converting Agent |
| Example II-1 | (B-5) | (A-4) | (8) | Dye A |

(Evaluation of Printing Performance)

Lithographic printing plate precursor (B-5) obtained was exposed with an infrared semiconductor laser emitting an infrared ray having a wavelength of 830 nm at plate surface laser power of 400 mW and scanning rate of 3.0 m/s. After exposure, the resulting plate was mounted on a Hidel KOR-D printing machine as such without development to conduct printing. The conditions of the fountain solution at this time are shown below. Fountain Solution: pH: 8.8 (water: 84.7%, isopropanol (IPA): 10%, triethylamine: 5%, concentrated hydrochloric acid: 0.3%)

Adhesion of ink on the image part of the printed matters was evaluated. Adhesion of ink at printing was observed when 1,000 sheets were printed and 2,000 sheets were printed, respectively. Good results were obtained in any case.

Example III

Preparation Example 1 of Hydrophilic Polymer

Polyacrylic acid (average molecular weight: 25,000) (18 g) was dissolved in 300 g of DMAc, and 0.41 g of hydroquinone, 19.4 g of 2-methacryloyloxyethylisocyanate and 0.25 g of dibutyltin dilaurate were added to the above solution and the reaction mixture was allowed to react for 4 hours at 65° C. The acid value of the obtained polymer was 7.02 meq/g. The carboxyl group was neutralized with an aqueous solution of 1N sodium hydroxide. The polymer was added to ethyl acetate to be precipitated, and thoroughly washed, thus a hydrophilic polymer was obtained.

Examples III-1

Production of Substrate

The surface of an aluminum plate having a thickness of 0.30 mm was grained with a nylon brush and an aqueous suspension of a 400 mesh pumice powder, then the aluminum plate was thoroughly washed with water. The aluminum plate was immersed in a 10 wt % aqueous solution of sodium hydroxide at 70° C. for 60 seconds to perform etching, washed with flowing water, neutralized with 20 wt % nitric acid, and then washed with water. The resulting aluminum plate was subjected to electrolytic surface roughening treatment under the condition of VA=12.7 V in a 1 wt % aqueous solution of nitric acid using sine wave alternating waveform electric current at anode-time electricity quantity of 160 C/dm$^2$. The substrate obtained had a surface roughness of 0.6 $\mu$m (indication in Ra). Subsequently, the aluminum plate was immersed in a 30 wt % aqueous solution of sulfuric acid at 55° C. for 2 minutes to be desmutted, and then anodized in a 20 wt % aqueous solution of sulfuric acid at a current density of 2 A/dm$^2$ for 2 minutes to form an anodic oxidation film in an amount of 2.7 g/m$^2$.

A liquid composition of a sol-gel method (a sol solution) was prepared according to the following procedure.

(Sol Solution)

| | |
|---|---|
| Methanol | 130 g |
| Water | 20 g |
| 85 wt % Phosphoric Acid | 16 g |
| Tetraethoxysilane | 50 g |
| 3-Methacryloxypropyltrimethoxysilane | 60 g |

The above composition of a sol solution was mixed and stirred. Exothermic heat was observed after about 5 minutes. The reaction mixture was allowed to react for 60 minutes, then the content was poured into other vessel and 3,000 g of methanol was added thereto, thus a sol solution was obtained. The sol solution was diluted with methanol/ethylene glycol (9/1, weight ratio), coated on the above-prepared substrate so that the amount of Si on the substrate reached 3 mg/m$^2$ and dried at 100° C. for 1 minute, thus an aluminum support was obtained.

(Preparation of Hydrophilic Layer)

The following composition was coated on the aluminum support, dried at 100° C. for 2 minutes, and subjected to UV exposure. Thus, a hydrophilic layer having a thickness of 1.55 $\mu$m was obtained.

(Coating Solution for Hydrophilic Layer B)

| | |
|---|---|
| Hydrophilic Polymer 1 or 2 (the structure is shown above) | 1.0 g |
| Photopolymerization Initiator PM 844 (the structure is shown below) | 0.1 g |
| Light-Heat Converting Agent (Dye A) (the structure is shown below) | 0.14 g |
| Distilled Water | 11.0 g |
| Acetonitrile | 5.5 g |

Structure of Water-Soluble Triazine Initiator PM 844:

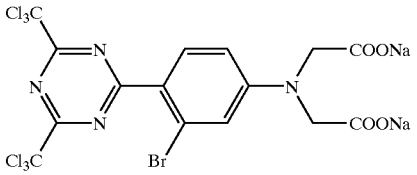

Structure of Light-Heat Converting Agent A:

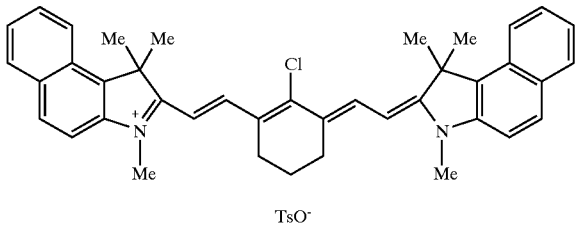

(Coating Solution for Hydrophilic Layer A)

| | |
|---|---|
| Hydrophilic Polymer 1 (the structure is shown above) | 1.0 g |
| Photopolymerization Initiator PM 844 (the structure is shown above) | 0.1 g |
| Distilled Water | 9.8 g |
| Acetonitrile | 4.8 g |

(Preparation of Recording Layer)

Each of the coating solution for a recording layer was prepared by changing the kinds of the polymer the solubility in water of which was changed by heat and a light-heat converting agent as shown in Table III-1. The prepared coating solution was coated on Hydrophilic Layer A or B, dried at 80° C. for 3 minutes, thus a lithographic printing plate precursor was obtained. Dry coating amount of the coating solution was 1.0 g/m$^2$.

(Preparation of Coating Solution for Recording Layer)

| | |
|---|---|
| Polarity Converting Polymer | 4.0 g |

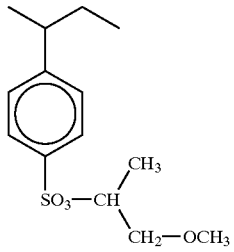

| | |
|---|---|
| Light-Heat Converting Agent (see Table III-1) | 0.4 g |
| Fluorine Surfactant (F-177, manufactured by Dainippon Ink & Chemicals, Inc.) | 0.006 g |
| Methyl Ethyl Ketone | 20 g |
| γ-Butyrolactone | 10 g |
| 1-Methoxy-2-propanol | 8 g |

TABLE III-1

| | | | Recording Layer | |
|---|---|---|---|---|
| Example No. | Lithographic Printing Plate Precursor | Hydrophilic Layer | Polymer (specific example No.) | Light-Heat Converting Agent |
| Ex. III-1 | (1) | (A) | (1) | Dye A |

(Note)
CB: Carbon black (MHI Black, #5257M, manufactured by Mikuni Sikiso Co., Ltd.)

Comparative Example

Substrates were prepared in the same manner as in the above production of substrate except that the coating solution was prepared by excluding 3-methacryloxypropyltrimethoxysilane in the sol solution of Example III-1, and the obtained solution was coated on the substrate to prepare each support. Each lithographic printing plate precursor was prepared according to the same procedure as in Example III-1. Evaluation of printing was performed in the same manner as in Example III-1 as described below. Any of the printing plates provided about 3000 sheets of prints. Evaluation of press life was inferior.

(Evaluation of Printing Performance)

The lithographic printing plates obtained in Example III-1 were exposed imaegwise with an LD laser emitting an infrared ray having a wavelength of 830 nm, after exposure, the resulting plates were each mounted on a Hidel KOR-D printing machine as such without development to conduct printing. When 5,000 sheets were printed, all printed sheets were clear, and no stains were observed in non-image areas.

While the invention has been described in detail and with reference to specific embodiment thereof, it will be apparent to one skilled in the art that various changes and modifications can be made therein without departing form the spirit and scope thereof.

What is claimed is:

1. A heat-sensitive lithographic printing plate precursor comprising a support having provided thereon a hydrophilic layer having a cross-linked structure which comprises a metal colloid-containing cross-linked polymer or a condensate of an organic hydrophilic polymer and a silane coupling agent, and a layer containing a polymer having on a side chain a group in which the solubility in water of the polymer can be changed by heat, said layer being provided on the hydrophilic layer wherein said polymer having on a side chain a group in which the solubility in water of the polymer can be changed by heat is a polymer having a secondary alkyl group represented by formula (6):

(6

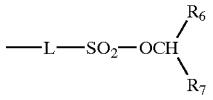

wherein L represents an organic group comprising a multivalent nonmetallic atom connected to a main chain of a polymer; $R_6$ and $R_7$ each represents a substituted or unsubstituted alkyl group or a substituted or unsubstituted aryl group; and $R_6$ and $R_7$ may form a ring together with a secondary carbon atom with which they are combined.

2. The heat-sensitive lithographic printing plate precursor as claimed in claim 1, wherein said hydrophilic layer is bonded to the support via a chemical bond by light.

* * * * *